US011186001B2

(12) United States Patent
Uit De Bulten et al.

(10) Patent No.: US 11,186,001 B2
(45) Date of Patent: Nov. 30, 2021

(54) SYSTEM AND A METHOD FOR TREATING A PART OF A BODY

(71) Applicant: KONINKLIJKE PHILIPS N.V., Eindhoven (NL)

(72) Inventors: Raymon Henk Uit De Bulten, Eindhoven (NL); Luc Berntsen, Eindhoven (NL); Everhardus Johannes Hoexum, Eindhoven (NL); Arjan Sander Vonk, Eindhoven (NL); Eduard Matheus Johannes Niessen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 8 days.

(21) Appl. No.: 15/032,180

(22) PCT Filed: Oct. 28, 2014

(86) PCT No.: PCT/EP2014/073040
§ 371 (c)(1),
(2) Date: Apr. 26, 2016

(87) PCT Pub. No.: WO2015/067498
PCT Pub. Date: May 14, 2015

(65) Prior Publication Data

US 2016/0263755 A1 Sep. 15, 2016

(30) Foreign Application Priority Data

Nov. 6, 2013 (EP) ..... 13191733

(51) Int. Cl.
*B26B 19/38* (2006.01)
*B26B 21/40* (2006.01)

(52) U.S. Cl.
CPC ..... *B26B 19/388* (2013.01); *B26B 21/4081* (2013.01)

(58) Field of Classification Search
CPC ... B26B 19/388; B26B 21/4081; B26B 19/00; Y10T 83/04; Y10T 83/164
See application file for complete search history.

(56) References Cited

U.S. PATENT DOCUMENTS 2,765,796 A 10/1956 Guenther
2,972,351 A 2/1961 Morgan
(Continued)

FOREIGN PATENT DOCUMENTS

EP 3065920 5/2019
WO 02/083257 10/2002
(Continued)

*Primary Examiner* — Kenneth E Peterson
*Assistant Examiner* — Liang Dong

(57) ABSTRACT

A system for treating a part of a body to be treated includes a hand-held treating device and a position identifier configured to generate information indicative of the position of the treating device relative to the part of the body to be treated. A controller is configured to determine a path and/or angle of orientation of the treating device relative to the part of the body to be treated in dependence of the information generated by the position identifier. The controller is also configured to operate a feedback module to provide feedback to a user based on the path and/or angle of orientation of the treating device determined by the controller.

20 Claims, 2 Drawing Sheets

(56) References Cited

U.S. PATENT DOCUMENTS 3,241,562 A 3/1966 Gronier
3,413,985 A 12/1968 Dlouhy
3,678,944 A * 7/1972 Berry ..... B26B 19/00 132/213.1
4,602,542 A 7/1986 Natrasevschi
5,007,234 A * 4/1991 Shurman ..... A01D 34/008 180/401
6,497,043 B1 12/2002 Jacobsen
2002/0088121 A1* 7/2002 Jacobsen ..... B26B 21/40 30/34.05
2006/0207103 A1* 9/2006 Tse ..... B26B 19/06 30/210
2008/0201955 A1* 8/2008 Leung ..... B26B 19/388 30/43.1
2009/0215015 A1 8/2009 Chu
2010/0164862 A1* 7/2010 Sullivan ..... G06T 7/246 345/156
2010/0170052 A1 7/2010 Ortins
2010/0186234 A1* 7/2010 Binder ..... H04N 13/239 30/34.05
2011/0018985 A1* 1/2011 Zhu ..... A45D 44/00 348/61
2012/0019641 A1* 1/2012 Reeder, III ..... F16M 13/022 348/61
2012/0227554 A1 9/2012 Beech
2012/0234146 A1* 9/2012 Lakin ..... B26B 19/00 83/76.2
2013/0021460 A1* 1/2013 Burdoucci ..... A45D 44/005 348/77
2015/0059187 A1* 3/2015 Krenik ..... B26B 19/42 30/123
2015/0197016 A1* 7/2015 Krenik ..... B26B 19/3806 83/13

FOREIGN PATENT DOCUMENTS

WO 2008084429 A1 7/2008
WO 2010/023629 3/2010
WO 2011/073010 6/2011
WO 2013011380 A2 1/2013
WO 2013096572 A1 6/2013
WO 2013163999 A1 11/2013
WO 2015/067498 5/2015

* cited by examiner

SYSTEM AND A METHOD FOR TREATING A PART OF A BODY

This application is the U.S. National Phase application under 35 U.S.C. § 371 of International Application No. PCT/EP2014/073040, filed on Oct. 28, 2014, which claims the benefit of International Application No. 13191733.8 filed on Nov. 6, 2013. These applications are hereby incorporated by reference herein.

FIELD OF THE INVENTION

The present invention relates to a system for treating a part of a body to be treated. In particular, the present invention relates to a system for cutting hair on a part of a body to be treated. The present invention also relates to a treating device configured to be used in a system as described above and a method for treating a part of a body to be treated.

BACKGROUND OF THE INVENTION

Devices for treating a part of a body, for example by cutting hair on a part of a body to be treated, include powered hand-held devices that are placed against a part of a body to be treated and moved over areas where hair is to be cut, for example a trimmer. Such devices include mechanical hair cutting devices. The user selects a cutting length by adjusting or selecting a guide, such as a comb, which extends over a cutting blade and then selects which areas of hair to cut and which areas should not be cut by positioning and moving the device appropriately.

When cutting a user's own hair, or someone else's hair, significant skill is required to create a particular hairstyle or to provide a presentable result. Although it is possible to use a trimmer to cut hair, such a device generally provides for cutting hair to a consistent length across the head. Such devices are difficult to accurately position on a user's head, for example. The accuracy of the treatment provided by the device depends on the user's skill and steady hand. Moreover, the device and the user's hand and arm may impede the user's view thereby making it difficult to position and move the device accurately.

SUMMARY OF THE INVENTION

It is an object of the invention to provide a system and/or a method for treating a part of a body to be treated which substantially alleviates or overcomes the problems mentioned above.

According to the present invention, there is provided a system for treating a part of a body to be treated comprising a hand-held treating device, and a position identifier configured to generate information indicative of the position of the treating device relative to the part of the body to be treated, wherein a controller is configured to determine a path and/or angle of orientation of the treating device relative to the part of the body to be treated in dependence of the information generated by the position identifier, and to operate a feedback module to provide feedback to a user based on the path and/or angle of orientation of the treating device determined by the controller.

With this arrangement it is possible for the system to operate a feedback module to provide feedback to a user based on the path of the treating device relative to the part of the body to be treated. Such an arrangement provides for determining a path of the treating device and providing feedback to help improve the level of treatment applied by the treating device. By providing feedback of the path of the treating device or feedback based on the determined path of the treating device it is possible to indicate to a user the path that is being taken, or to indicate a path that should be taken, based on the current path. An advantage of this arrangement is that the user is provided with an indication to assist the user to achieve a better treatment.

Furthermore, when the angle of orientation is determined relative to the part of the body to be treated it is possible for the controller to operate a feedback module to provide feedback on the angle of orientation, for example that the angle of orientation is correct, or an indication of how to move the treating device to ensure a desired angle of orientation of the treating device is achieved.

The controller may be configured to track the path and/or angle of orientation of the treating device and to compare the path and/or angle of orientation of the treating device tracked by the controller with a reference profile indicative of the part of the body to be treated to determine an area of the part of the body to be treated that has been treated by the treating device based on the path and/or angle of orientation of the treating device tracked by the controller.

The controller may be configured to operate said feedback module to provide an indication of the area of the part of the body to be treated that has been treated by the treating device.

An advantage of the above arrangements is that it is possible to provide feedback on the part of the body that has been treated, and/or to provide feedback on the part of the body that has not been treated. Therefore, it is possible for a user to easily identify regions that have already been treated and so do not need further treatment, and/or regions that are yet to be treated. This helps to ensure that all of the part of the body to be treated has been treated. Such an arrangement helps to prevent regions of the part of the body to be treated from being missed during use of the system. This may help to ensure that a uniform treatment is applied. For example, with a treating device configured as a cutting device for hair, the arrangement helps to ensure that all of the hair on a user's head is cut, and that a region isn't missed. Alternatively, or as well as, the above arrangements may help to prevent excess treatment being applied to one or more areas of the part of the body to be treated. Therefore, excess treatment, which may cause damage or irritation, for example, is avoided.

The controller may be configured to operate said feedback module when the controller has determined that a predefined area of the part of the body to be treated has been treated by the treating device.

This helps to notify a user that treatment of a predefined area of the part of the body to be treated has been completed, and so may prevent a user from spending excess time on the treatment. Furthermore, the user will be aware that they have not completed treatment if no notification has been received.

The controller may be configured to operate said feedback module when the controller has determined that the treating device has treated all of the part of the body to be treated.

This helps to notify a user that treatment of the part of the body to be treated has been completed.

The system for treating a part of a body to be treated may be a system for cutting hair on a part of a body to be treated, and the treating device may be a cutting device.

With such an arrangement, it is possible to provide a system for cutting hair which enables feedback to be provided to help guide a user with cutting hair on a part of a body to be treated.

The controller may be configured to refer to a reference profile indicative of the direction of growth of hair on the part of the body to be treated for a given position or positions of the cutting device relative to the part of the body to be treated, and the controller may be further configured to operate said feedback module to provide an indication of a desired path and/or angle of orientation of the cutting device relative to the part of the body to be treated based on the reference profile indicative of the direction of growth of hair and the information generated by the position identifier.

Hair is known to grow in different directions, however regions of hair tend to have a direction of growth, also known as the grain of the hair. By the controller referring to a reference profile and operating the feedback module to provide feedback based on the indication of the direction of growth provided for a given position of the cutting device relative to the part of the body to be treated, it is possible to operate the feedback module to indicate a desired path to maximise the effectiveness of the cutting action. For example, it has been found that cutting against the grain of hair increases the cutting action of a cutting device. Therefore, the efficiency or effectiveness of the cutting action increases when cutting against the grain of the hair.

The cutting device may comprise a driver for driving the cutting device, and a sensor to detect the load acting on the driver during use of the cutting device, wherein the controller may be configured to determine the direction of growth of hair on the part of a body to be treated in dependence on the load acting on the driver detected by the sensor together with the path and/or angle of orientation of the cutting device relative to the part of the body to be treated determined by the controller.

By determining the load acting on the driver it is possible to determine when hair is being cut. Therefore the effectiveness and efficiency of the system may be maximised. It is also possible to determine the direction of growth of hair by determining when the hair is being cut, and when the hair is not being cut, dependent on the direction in which the cutting device is moved relative to the part of the body to be treated, and therefore over the part of the body to be treated.

The controller may be configured to operate said feedback module to provide an indication of a desired path and/or angle of orientation of the cutting device relative to the part of the body to be treated based on the determined direction of growth of hair on the part of the body to be treated.

With such an arrangement it is possible to maximise the cutting efficiency by operating the feedback module to indicate a desired movement to a user based on the determined direction of growth. For example, it is possible for the controller to operate the feedback module to indicate to the user a desired path of the cutting device to ensure that the cutting device moves along a path against the direction of growth of the hair on the part of the body to be treated.

The controller may be configured to form a profile of the part of the body to be treated based on the determined direction of growth of hair on the part of the body to be treated together with the information generated by the position identifier.

An advantage of such an arrangement is that it is possible to form a profile of the direction of growth of hair for a particular part of the body to be treated, so that the cutting device is able to refer to the profile to ensure that all the hair is cut by the cutting device.

The controller may be configured to cause the profile to be stored for reference.

With such an arrangement it is possible for the controller to store the profile in a memory, for example, and then refer to the stored profile for future use.

The controller may be configured to operate said feedback module to indicate the direction of growth of hair on the part of the body to be treated and/or a desired path and/or angle of orientation of the cutting device relative to the part of the body to be treated based on the profile of the part of the body formed by the controller and the determined path and/or angle of orientation of the cutting device relative to the part of the body to be treated.

The system may further comprise a feedback module to provide feedback to a user. The feedback module may be configured to provide visual, audible and/or tactile feedback to a user.

An advantage of tactile feedback is that the treating device is able to directly transmit the desired feedback to the hand of a user holding the treating device.

The controller may be configured to operate the feedback module to provide feedback to a user to provide an indication of a desired path and/or angle of orientation of the treating device to follow based on information indicative of the position of the treating device relative to the part of the body to be treated.

The feedback module may include a display, and the controller may be configured to operate the display to show a map of the part of the body to be treated on the display, and to provide an indication on the map of the desired path and/or angle of orientation of the cutting device relative to the part of the body to be treated.

With such an arrangement it is relatively straightforward for the user to interpret the path and/or angle of orientation of the cutting device without being able to directly view the cutting device.

The position identifier configured to generate information indicative of the position of the treating device relative to the part of the body to be treated may comprise an imaging module configured to generate information indicative of the position of the treating device relative to the part of the body to be treated based on an image of a part of the body and the treating device.

Therefore, the system is operable to determine the position of the treating device based on an image of a part of the body and the treating device. This minimises the number of components that are required.

The image of a part of the body and the treating device may be an image of the part of the body to be treated and the treating device.

Therefore, the accuracy of the system may be maximised due to the image being an image of the part to be treated. Furthermore, the arrangement of the system is simplified because the imaging module is able to provide direct information about the part of the body to be treated.

The image of a part of the body and the treating device may be an image of a user's head and the treating device, wherein the imaging module may be configured to detect a gaze direction of the user's head based on the image of the user's head and the treating device.

The imaging module may be configured to detect the gaze direction of the user's head based on detection of one or more objects in the image of the user's head and the treating device and, optionally, based on detection of the user's nose and/or ears in the image of the user's head and the treating device.

With this arrangement the imaging module is capable of accurately providing information indicative of the position of the treating device relative to the user's head by detecting one or more easily identifiable objects, such as features of the head. Furthermore, by detecting the user's nose and/or ears in the image of the user's head it is possible to easily identify the gaze direction and/or determine the location of other parts of the user's head due to the user's nose and/or ears being in a fixed location relative to other parts of the user's head. It will also be recognised that the user's nose and/or ears are easily determinable by an imaging module due to the objects protruding from the remainder of the head. Although the user's nose and/or ears are easily determinable by an imaging module, it will also be recognised that the position of other features may be determined, for example a user's eyes and/or mouth due to their contrast with the remainder of the user's face.

The position identifier configured to generate information indicative of position of the treating device relative to the part of the body to be treated may comprise an electromagnetic field detector configured detect changes in an electromagnetic field to generate information indicative of the position of the treating device relative to the part of the body to be treated based on a detected electromagnetic field.

With this arrangement it is possible to provide a straightforward means of generating information indicative of position of the treating device relative to the part of the body to be treated.

The controller may be configured to adjust an operating characteristic of the treating device in dependence on the information generated by the position identifier.

The treating device may further comprise a guide face configured to space the treating unit from the part of the body to be treated during use of the system, the distance between the treating unit and the guide face being adjustable. The operating characteristic may be the distance between the treating unit and the guide face.

According to another aspect of the invention, there is provided a treating device configured to be used in the system as described above.

According to another aspect of the invention, there is provided a method of treating a part of a body to be treated using a treating device comprising generating information indicative of the position of the treating device relative to the part of the body to be treated using a position identifier, determining a path and/or angle of orientation of the treating device relative to the part of the body to be treated in dependence on the information generated by the imaging module, and operating a feedback module to provide feedback to a user in dependence on the determined path and/or angle of orientation of the treating device.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
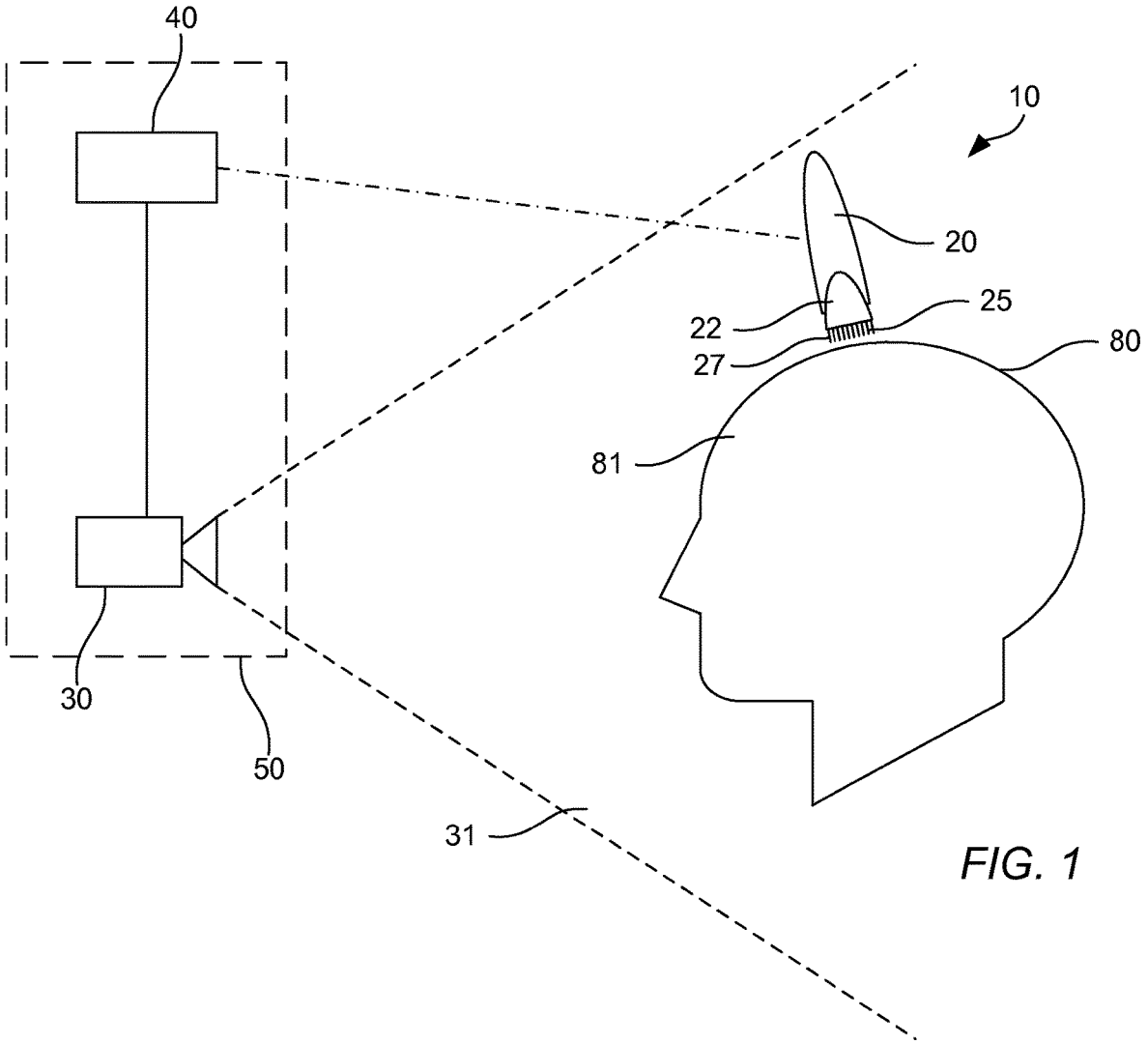
FIG. 1 shows a schematic view of a system for cutting hair.

Embodiments described herein describe a system for cutting hair. Referring to FIG. 1, a system for cutting hair 10 is shown. The system for cutting hair 10 acts as a system for treating part of a body to be treated. The system 10 comprises a cutting device 20, and a camera 30. The camera 30 acts as an imaging module. The camera 30, acting as an imaging module, is a position identifier configured to generate information indicative of the position of the treating device relative to the part of the body to be treated. That is, a position identifier is capable of generating information indicative of the position of one or more elements. The system 10 further comprises a controller 40. The controller 40 is configured to operate the cutting device 20.

Although in the present described embodiments the position identifier is an imaging module, it will be understood that alternative means or complimentary means of generating information indicative of the position of one or more elements, in particular a part of a body to be treated and a cutting device, may be used. Examples of such a position identifier includes electromagnetic field detection, microwave detection, inertial measurement, and/or ultrasonic detection. An example of a system using electromagnetic field detection to generate information indicative of the position of the treating device relative to the part of the body to be treated is known from WO2013/096572.

In the embodiments described herein, the system 10 is described by reference to the user of the system 10 being the person being treated. That is, the user is using the system to treat themselves. However, it will be understood that in an alternative embodiment the user is a person using the system 10 to apply treatment using the system 10 to another person.

The camera 30 and controller 40 form part of a base unit 50. Alternatively, the camera 30 and controller 40 are disposed separately. In one embodiment, the controller 40 is in the cutting device 20. The camera 30, controller 40 and cutting device 20 communicate with each other. In the present embodiment the camera 30 and controller 40 communicate via a wired connection. The controller 40 and the cutting device 20 communicate via a wireless connection. Alternative arrangements are envisaged. For example, the controller 40 and cutting device 20 may be connected by a wired connection, and/or the controller 40 and the camera 30 may be connected by a wireless connection. Wireless modules, for example radio or infra-red transmitters and receivers, act to wirelessly connect the different components. It will be understood that WiFi™ and Bluetooth™ technologies may be used.

The base unit 50 in the present embodiment is a dedicated part of the system 10. However, it will be understood that the base unit 50 may be a device having an imaging module and a controller, amongst other components. For example, the base unit 50 may be or comprise a mobile phone, tablet computer or laptop computer, another mobile device, or a non-mobile device such as a computer monitor with an in-built or attached camera.

Figure 2:
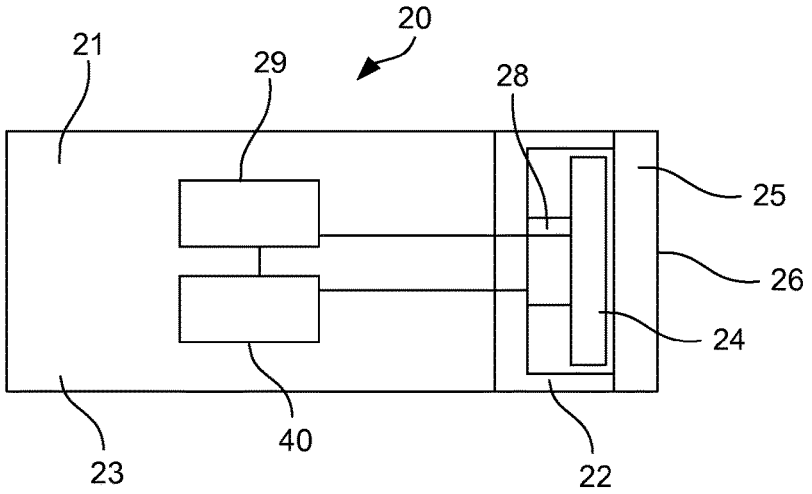
FIG. 2 shows a schematic view of a cutting device.

Referring to FIGS. 1 and 2, the cutting device 20 is a hand-held electrical hair trimming device. However, it will be apparent that the cutting device 20 may have an alternative arrangement. For example, the cutting device 20 may be a hand-held electrical shaving device. The cutting device 20 acts as a treating device. The cutting device 20 is moved over a skin 80 of a part of a user's body, for example their head 81, to trim hair on that part of the body. The cutting device 20 comprises a main body 21 and a cutting head 22 at one end of the main body 21. The main body 21 defines a handle portion 23. The body 21 and the cutting head 22 are arranged so that the handle portion 23 is able to be held by a user.

The cutting head 22 has a cutting unit 24. The cutting unit 24 is configured to trim hair. The cutting unit 24 acts as a treating unit. The cutting unit 24 has one or more stationary treating element(s) (not shown), and one or more moveable treating element(s) which move relative to the one or more stationary treating element(s). Hairs protrude past the stationary treating element, and are cut by the moveable treating element. In particular, in one embodiment the cutting unit 24 comprises a stationary blade (not shown), acting as a stationary treating element, and a moveable blade (not shown), acting as a moveable treating element. The stationary blade has a stationary edge comprising a first array of teeth. The moveable blade has a moveable edge comprising a second array of teeth. The stationary edge and moveable edge are aligned parallel to each other. The moveable blade is moveable in a reciprocal manner against the stationary blade in a hair shearing engagement. Therefore, the second array of teeth is arranged to move in a reciprocal motion relative to the first array of teeth. In the present embodiment, the stationary treating element and the moveable treating element form cooperating mechanical cutting parts (not shown).

Although one cutting unit is described above, it will be understood that the cutting head 22 may comprise two or more cutting units. Although in the present arrangement the cutting unit comprises one or more stationary treating element(s) and one or more moveable treating element(s), it will be understood that alternative cutting arrangements are envisaged. For example, the cutting unit 24 may comprise a foil (not shown) through which hairs protrude, and a moving blade (not shown) which moves over the foil.

The cutting unit 24 is driven by a driver 29. The driver 29 acts to drive the cutting unit 24 in a driving action. In the present embodiment, the driver 29 is an electric motor. The driver 29 drives the moveable element(s) relative to the stationary element(s). The driver 29 is controlled by the controller 40.

The cutting head 22 has a guide 25. The guide 25 has a guide face 26. The guide face 26 forms an end surface. The guide face 26 is configured to be disposed against the part of the body to be treated. The guide face 26 is spaced from the cutting unit 24. However, in one embodiment the cutting head 22 may be adjustable so that the guide face 26 and the cutting unit 24 lie planar with each other. The guide face 26 is arranged to space the cutting head 22 from the part of the body to be trimmed, for example the skin 80 of a user's head 81. In another embodiment the guide 25 may be omitted.

In the present embodiment, the guide 25 is a comb. The guide 25 has a plurality of parallel, but spaced, comb teeth 27. The spaced comb teeth 27 allow the passage of hair therebetween to be exposed to the cutting unit 24 to be cut by the cutting unit 24. A distal surface of each tooth from the main body 21 forms the guide face 26. The guide 25 is mounted to the main body 21. The guide 25 is removably mounted to the main body 21. This enables the cutting unit 24 to be cleaned, and the guide 25 to be interchangeable with another guide and/or replaced.

The guide 25 has a leading edge. The leading edge is aligned with the moveable edge of the moveable treating element, but is spaced therefrom. The leading edge forms an edge of the guide face 26. The leading edge is defined by ends of the comb teeth 27. The leading edge defines an intersection between the guide face 26 of the guide 25 and a front face of the guide 25.

The distance between the guide face 26 and the cutting unit 24 is adjustable. That is, the guide face 26 and the cutting unit 24 are moveable towards and away from each other. In the present embodiment the guide 25 is fixedly mounted to the main body 21. That is, the guide 25 is prevented from moving towards or away from the main body 21. However, the guide 25 may pivot about the main body 21. The cutting unit 24 is movably mounted to the main body 21. That is, the cutting unit 24 is movable towards and away from the guide face 26. The cutting unit 24 may also be pivotable relative to the main body 21. An actuator 28 acts on the cutting unit 24. The actuator 28 extends in the cutting head 22. The actuator 28 is operable to move the cutting unit 24 relative to the guide face 26. The actuator 28 is a linear actuator, and may be a mechanical actuator or an electro-magnetic actuator, for example.

The cutting unit 24 of this embodiment is mounted on the actuator 28 which is configured to move the cutting unit 24 in a linear direction towards and away from the skin contacting guide face 26, and therefore the skin 80 of the user, during use. The actuator 28 moves the cutting unit 24 in response to commands from the controller 40.

Depending on the type of actuator used, the cutting unit 24 may be mounted on a linear sliding guide or rail such that the cutting unit 24 moves, under influence of the actuator 28, and remains parallel to the guide face 26. The movement may be in direction which is perpendicular to the guide face 26, or it may be at an angle.

With the above arrangement, the cutting unit 24 moves relative to the guide face 26. Therefore, the guide face 26 is maintained in a stationary position with respect to the main body 21. This means that the distance between the guide face 26 and the handle 23 does not change during use of the cutting device 20. Therefore, there is no perceived movement of the cutting device 20 in a user's hand.

The distance between the cutting unit 24 and the guide face 26 is variable such that the cutting device 20 is at or between a minimum condition, in which the distance between the cutting unit 24 and the guide face 26 is at a minimum value, and a maximum condition, in which the distance between the cutting unit 24 and the guide face 26 is at a maximum value.

The cutting device 20 of the present embodiment is configured to have a maximum condition of about 100 mm. However, it will be understood that alternative ranges are possible. For example, a shaver for trimming facial hair may be configured to set a maximum condition of 10 mm. Such a reduced range may increase the accuracy of the cutting device 20.

Although in the above described embodiment the cutting unit 24 is movable relative to the guide face 26, in an alternative embodiment the guide 25, and therefore the guide face 26, is movable relative to the cutting unit 24. The cutting unit 24 may be fixedly mounted to the main body 21, and the guide 25 may be movable relative to the main body 21. In such an embodiment, the actuator acts on the guide 25. The guide face 26 is movable towards and away from the cutting unit 24. The guide 25 may be slideable on one or more rails to slide relative to the cutting unit 24. With such an embodiment, the arrangement of the cutting unit 24 is simplified.

In the above described arrangement the distance between the guide face 26 and the cutting unit 24 is adjustable by means of operation of the actuator 28. However, in one embodiment the distance between the guide face 26 and the cutting unit 24 is also manually adjustable by a user.

The camera 30, acting as an imaging module, is a depth or range camera. That is, the camera 30 uses range imaging to determine the position of elements within the field-of-view, or optical sensing zone 31, of the camera 30.

Although different arrangements for adjusting the distance between the guide face 26 and the cutting unit 24 are given above, it will be understood that in an alternative embodiment the distance between the guide face 26 and the cutting unit 24 is not adjustable. The guide face 26 and the cutting unit 24 may be fixedly mounted to each other. In one embodiment the guide may be removable and the system 10 may include two or more interchangeable guides which have different arrangements, for example to provide different distances between the guide face 26 and the cutting unit 24. In such arrangements the system 10 may be usable with the guide 25 removed from the remainder of the cutting device 20.

The camera 30 produces a two-dimensional image with a value for the distance of elements within the optical sensing zone 31 from a specific position, such as the camera sensor itself. In the present embodiment the camera 30 is configured to employ a structured light technique to determine the position, including the distance, of elements within the optical sensing zone 31 of the camera 30. Such a technique illuminates the field of view with a specially designed light pattern. An advantage of this embodiment is that the depth may be determined at any given time using only a single image of the reflected light. Alternatively, the camera 30 is configured to employ a time-of-flight technique to determine the position, including the distance, of elements within the field of view of the camera 30. An advantage of this embodiment is that the number of moving parts is minimised. Other techniques include echographic technologies, stereo triangulation, sheet of light triangulation, interferometry, and coded aperture.

The camera 30 is a digital camera capable of generating image data representing a scene received by the camera's sensor. The image data can be used to capture a succession of frames as video data. The optical sensing zone 31 is the field-of-view within which optical waves reflecting from or emitted by objects are detected by the camera's sensors. The camera 30 detects light in the visible part of the spectrum, but can also be an infra-red camera.

The camera 30, acting as the imaging module, is configured to generate information indicative of the position of elements within the optical sensing zone 31. The camera 30 generates the information based on the image data generated by the camera's sensor.

In the present embodiment, the camera 30, acting as the imaging module, generates a visual image with depth, for example an RGB-D map. The camera 30 generates a visual image with depth map of the elements within the optical sensing zone 31 of the camera 30. Alternative means of generating information indicative of the position of elements within the optical sensing zone 31 are anticipated. For example, the camera 30 may generate a depth image (D-map) of the elements within the optical sensing zone 31.

The camera 30 is configured to generate a visual image with depth map with 30 frames per minute. Furthermore, the camera 30 has a resolution of 640×480. The depth range is between 0.4 m and 1.5 m. The angle of the field-of-view is between 40 degrees and 50 degrees. This provides a suitable area for a user to be positioned within the optical sensing zone 21. The depth resolution is configured to be about 1.5 mm within the optical sensing zone 21.

Whilst the above parameters have been found to be sufficient for accurate determination of position for cutting hair, it will be understood that alternative parameters may be used. For example, a filter (not shown) may be used to enhance accuracy of the available resolution.

Figure 3:
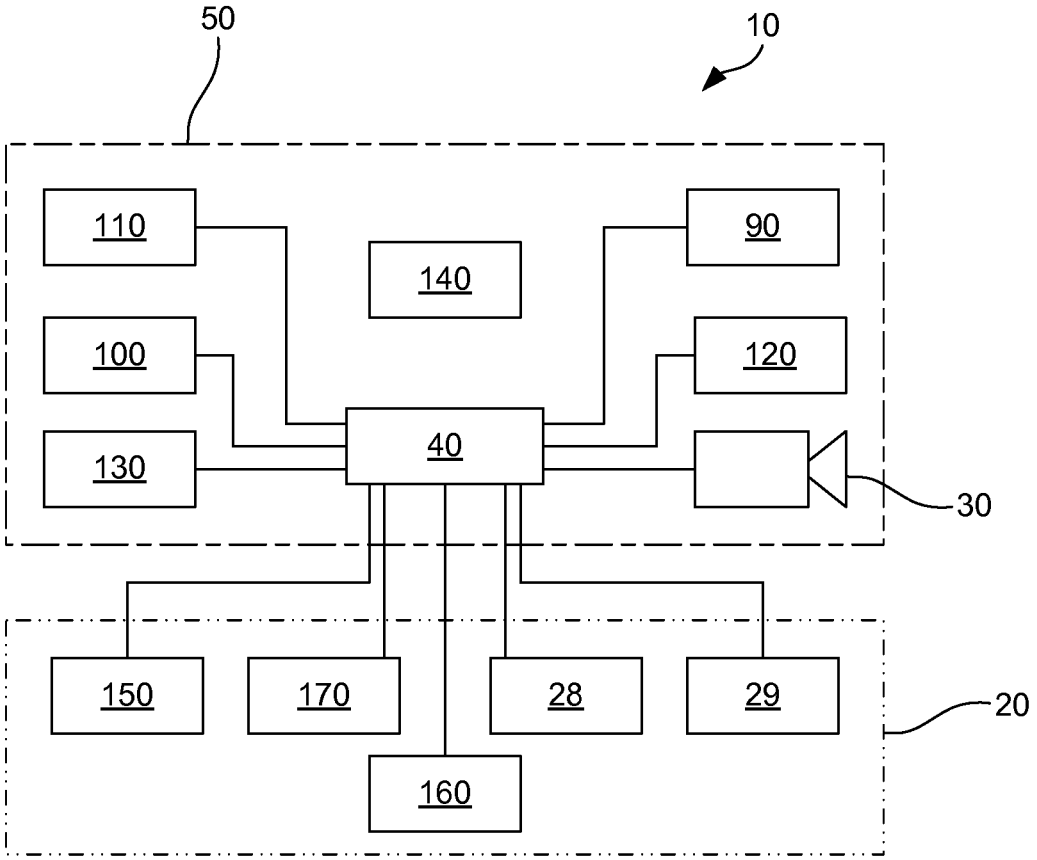
FIG. 3 shows a schematic diagram of the system of FIG. 1.

FIG. 3 shows a schematic diagram of selected components of the system 10. The system 10 has the cutting device 20, the camera 30, and the controller 40. The system 10 also has a user input 90, memory 100, RAM 110, one or more feedback modules, for example including a speaker 120, a vibration motor 160, and/or a display 130, and a power supply 140. Furthermore, the system 10 has an inertial measurement unit (IMU) 150.

The memory 100 may be a non-volatile memory such as read only memory (ROM), a hard disk drive (HDD) or a solid state drive (SSD). The memory 100 stores, amongst other things, an operating system. The memory 100 may be disposed remotely. The controller 40 may be able to refer to one or more objects, such as one or more profiles, stored by the memory 100 and upload the one or more stored objects to the RAM 110.

The RAM 110 is used by the controller 40 for the temporary storage of data. The operating system may contain code which, when executed by the controller 40 in conjunction with the RAM 110, controls operation of each of the hardware components of the system 10. The controller 40 may be able to cause one or more objects, such as one or more profiles, to be stored remotely or locally by the memory 100 and/or to the RAM 110.

The power supply 140 may be a battery. Separate power supply units of the power supply may separately supply the base unit 50 and the cutting device 20. Alternatively, one power supply unit may supply power to both the base unit 50 and the cutting device 20. In the present embodiments, the or each power supply unit is an in-built rechargeable battery, however it will be understood that alternative power supply means are possible, for example a power cord that connects the device to an external electricity source.

The controller 40 may take any suitable form. For instance, the controller 40 may be a microcontroller, plural controllers, a processor, or plural processors. The controller 40 may be formed of one or multiple modules.

The system 10 also comprises some form of user interface. Optionally, the system 10 includes additional controls and/or displays for adjusting some operating characteristic of the device, such as the power or cutting height, and/or informing the user about a current state of the device.

The speaker 120 is disposed in the base unit 50. Alternatively, the speaker may be on the cutting device 20 or disposed separately. In such an arrangement, the speaker will be disposed close to a user's head to enable audible signals generated by the speaker 120 to be easily heard by a user. The speaker 120 is operable in response to signals from the controller 40 to produce audible signals to the user. It will be understood that in some embodiments the speaker 120 may be omitted.

The display 130 is disposed in the base unit 50. Alternatively, the display 130 may be disposed on the cutting device 20 or disposed separately. The display 130 is operable in response to signals from the controller 40 to produce visual indicators or signals to the user. It will be understood that in some embodiments the display 130 may be omitted.

The feedback module, or one of the feedback modules, may also include a vibration motor 160, for example to provide tactile feedback to a user. The vibration motor 160, or another tactile feedback means, is disposed in the cutting unit 20.

The user input 90 in the present embodiment includes one or more hardware keys (not shown), such as a button or a switch. The user input 90 is disposed on the base unit 50, although it will be understood that the user input 90 may be on the cutting device 20, or a combination thereof. The user input 90 is operable, for example, to enable a user to select an operational mode, to activate the system 10, and/or disable the system 10. The user input 90 may also include mechanical means to allow manual adjustment of one or more operating characteristics of the system 10.

The inertial measurement unit 150 is in the cutting device 20. In the present arrangement, the IMU 150 is received in the main body 21 of the cutting device 20. IMUs are known and so a detailed description will be omitted herein. The IMU 150 is configured to provide the readings of six axes of relative motion (translation and rotation). The IMU 150 is configured to generate information indicative of the position of the cutting device 20. The information generated by the IMU 150 is provided to the controller 40.

Although in the present and other described embodiments the position identifier is an imaging module, it will be understood that alternative means or complimentary means of generating information indicative of the position of one or more objects, in particular a part of a body to be treated and a cutting device, may be used. Examples of such a position identifier include electromagnetic field detection, microwave detection, inertial measurement, and/or ultrasonic detection. A detailed description of the alternative arrangements has been omitted. For example, the camera 30, acting as an imaging module, may be omitted and the IMU 150 may be used to generate information indicative of the position of the cutting device 20. With such an arrangement, the information indicative of the position of the cutting device 20 generated by the IMU 150 is provided to the controller 40 and/or referred to by the controller 40, and the controller 40 is configured to adjust an operating characteristic of the treating device in dependence on the information generated by the IMU 150.

In alternative embodiments, the position identifier has or includes an alternative means to generate information indicative of the position of one or more objects, in particular a part of a body to be treated and the cutting device 20. Such alternative means may be used instead of or in combination with one of or both of an imaging module or an IMU. For example, the position identifier may be configured to generate information indicative of the position of one or more objects based on acoustic detection, ultrasonic detection, infrared signals, detection of signal propagation time and/or angles, and/or another technique for analysing signals may be used.

Cutting device 20 may include one or more accelerometers, gyroscope or other position and/or orientation monitoring sensors to determine the position and/or orientation of cutting device 20.

In one embodiment the position identifier is configured to generate information indicative of position of the treating device 20 based on electromagnetic field detection. In such an embodiment the position identifier comprises one or more electromagnetic field detectors (not shown). The one or more electromagnetic field detectors configured detect changes in an electromagnetic field to generate information indicative of the position of the treating device relative to the part of the body to be treated based on a detected electromagnetic field.

In one embodiment one or more position indicators (not shown) which are detectable by the position identifier may be mounted to a part of the body, such as the part of the body to be treated. Such position indicators may be inactive, or may be active, for example by transmitting a signal to be detected by the position identifier. Such signals may include electro-magnetic signals, acoustic signals, ultrasonic signals, infrared signals, visual signals, and/or optical signals.

The position identifier may be may be mounted to the part of the body to be treated, generate information indicative of the position of the part of the body to be treated and/or the cutting device based on signals received from another part of the system, for example the cutting device 20. The position identifier may be on the cutting device. Any combination of the above described means for generating information indicative of the position of one or more objects may be used. The system 10 may use one or more different techniques to generate information indicative of the position of the treating device relative to the part of the body to be treated.

The system 10 of FIG. 1 is operated by disposing the base unit 50 in a suitable location for cutting hair. That is, the base unit 50 is positioned so that the user is able to position the part of the body to be treated, for example the head, within the optical sensing zone 21. For example, the camera 30 is disposed around a height at which a user's head will be positioned during operation of the system 10. In an embodiment in which the camera 30 is separate from the base unit 50, or the base unit is omitted, the camera 30 is positioned as necessary. The hand-held cutting device 20 is held by the user.

The system 10 is actuated by a user. The controller 40 controls the driver 29 to operate the cutting unit 24 in a cutting mode. It will be understood that the cutting unit 24 may have more than one treating modes. The controller 40 controls the actuator 28 to determine the position of the cutting unit 24 relative to the guide face 26.

When the system is actuated, the cutting device 20 is at or between a minimum condition, in which the distance between the cutting unit 24 and the guide face 26 is at a minimum value, and a maximum condition, in which the distance between the cutting unit 24 and the guide face 26 is at a maximum value. The controller 40 initially moves the cutting device 20 into a maximum condition so that the hair is not able to be accidentally cut to a shorter length than desired.

The user uses the system 10 by holding the hand-held cutting device 20 and moving the cutting device 20 over areas of part of the body from which hair is to be cut. The guide face 26 of the cutting head 22 is placed flat against the skin and hairs being received through the guide 25 and interacting with the cutting unit 24 are cut. For example, for trimming hair in the scalp area of a user's head 81, the user positions the guide face 26 against the scalp and moves the cutting device 20 over the skin 81 from which hair to be trimmed protrudes. The user can move the cutting device 20 around the surface of the scalp. The hair being cut as the cutting device 20 is moved over the skin 81 will depend on the size and shape of the guide face 26 of the guide 25 which is disposed proximate to the skin and also on the size, shape and arrangement of the cutting unit 24 of the cutting head 22.

With a conventional trimmer, the extent of the cutting action of the trimmer is difficult to predict and control and the user relies on their skill and steady hand to move the device in the appropriate manner. Furthermore, the length of the hair to be cut is dependent on a user controlling a distance between the guide face of the device and the user's skin such that the trimmed length of the hair being cut, or by moving the guide into a desired position to set the cut length. This can be difficult when holding the device as any undue movement of the skin or hand may cause a mistake. Furthermore, the device and/or the hand or arm of the user may obstruct the view of the user when the device is in use and this may result in the device being moved in an undesired manner and cause inaccuracies or mistakes. Therefore, it is difficult to use such a device to achieve accurate cutting of hairs.

The invention as defined in the claims provides a system for treating a part of a body to be treated, including cutting hair, which allows for variations in the treatment, such as cutting hair, applied to a part of the body to be treated dependent on the position of the treating device relative to the part of the body to be treated. The system 10 is operable to provide information indicative of the path and/or angle of orientation of the treating device relative to the part of the body to be treated, and to operate a feedback module to provide feedback to a user based on the path and/or angle of orientation of the treating device determined by the controller 40.

The controller 40 is configured to determine a path of the cutting device 20, acting as a treating device, based on information generated by the camera 30, acting as a position identifier. In particular, the controller 40 may be configured to determine the path of the cutting device 20 relative to the part of the body to be treated by monitoring the information generated by the camera 30 and determining the change in position of the cutting device 20 relative to the part of the body to be treated based on the determined change in position of the cutting device 20 relative to the part of the body to be treated over a predetermined time period. The controller 40 may also, or alternatively, determine the angle of orientation of the cutting device 20 relative to the part of the body to be treated. Alternatively, or in combination with, the camera 30 may be configured to calculate the absolute angle of orientation of the cutting device 20 relative to the part of the body to be treated based on the orientation of features of the main body 21 and/or cutting head 22 of the cutting device 20. With such an arrangement it is possible to determine the angle of orientation without detecting any movement of the cutting device 20 relative to the part of the body to be treated.

The method of how the system 10 is used comprises an initial step of the user, who may be cutting hair on a part of their own body, or of another user's body, positions the cutting device 20 with respect to the part of the body on which hair is to be cut, for example the user's head. The camera 30, acting as the imaging module, is operable to generate information indicative of the position of the cutting device 20, as well as the part of the body to be treated. The controller 40 is configured to determine the path of the cutting device 20, and or the angle of orientation of the cutting device 20 in dependence on the generated information indicative of the position of the cutting device 20, as well as the part of the body to be treated and a time period. In the present embodiment, the camera 30 generates image data representing a scene received by the camera's sensor within the optical sensing zone 21. With such an embodiment, the camera 30 produces a depth map of the objects within the optical sensing zone 31.

The camera 30 is operable to generate information indicative of the part of the body to be treated based on the image produced of objects within the optical sensing zone 31. For example, the camera 30 is operable to generate information indicative of the user's head based on the image produced within the optical sensing zone 31 including the user's head. The camera 30 is configured to generate information indicative of the position and/or orientation of the user's head. To effectively determine the location of the user's head from the available map of the objects within the optical sensing zone 31, features of the user's head are identified.

In such an embodiment, the camera 30 is configured to detect a gaze direction of the user's head. That is, the direction in which the head is directed relative to the camera 30. Detection of the gaze direction of the user's head based on detection of one or more objects in the image of the user's head and the treating device and, optionally, based on detection of the user's nose and/or ears in the image of the user's head and the treating device. It has been found that a user's nose and/or ears are easily locatable in an image produced of objects in the optical sensing zone 31. As a user's nose and ears protrude from the remainder of a user's head, the camera 30, it has been found that one or more of these objects are easily locatable in an image including a user's head.

Features of the user's head, for example the user's nose and/or ears, are identified by the camera 30. It has been found that the nose and ears may be detected rapidly and continuously in the depth map produced by the camera 30, acting as the imaging module, using a known detection method, for example 3D pattern matching. Although in the present arrangement the camera 30 is configured to identify the user's nose and/or ears, it will be understood that the camera 30 may be configured to detect one or more alternative features of the part of the body in the optical sensing zone 31. For example, the camera 30 may be configured to detect the shape of the user's head, eyes, lips, blemishes, scars, birthmarks and/or other facial features. Such features may be identified by the camera 30 and stored by the controller 40 in the memory 100 for reference during use of the system 10, or during future use of the system 10.

An advantage of the camera 30 being configured to detect a gaze direction of the user's head based on detection of the user's ears and nose in the image of the user's head is that generally two or more of these three features will be identifiable in the image of the part of the body irrespective of the gaze direction of the user's head. Therefore, from the overall position and orientation of these three features, it is possible to generate information indicative of the position of the head across a range of different head positions relative to the camera 30. Therefore, movements of the head may be accommodated during use of the system.

The camera 30 is operable to generate information indicative of the cutting device 20, acting as a treating device. The shape of the cutting device 20 is known and may be stored, for example by the memory 100, to be referred to during operation of the camera 30. The position of the cutting device 20 is determined in a similar manner to that of the part of the body to be treated. To effectively determine the location of the cutting device 20 from the available map of the objects within the optical sensing zone 31, features of the cutting device 20 are identified. The cutting device 20 may be provided with markers (not shown) which are easily recognisable by the camera 30.

The camera 30 is able to generate information indicative of the cutting device 20 on a continuous or predefined interval basis. The camera 30 is therefore capable of providing information indicative of the path of the cutting device 20 relative to the part of the body to be treated. The controller 40 is configured to determine movement based on a comparison of the relative positions of the cutting device 20 over a predetermined time period. The controller 40 is therefore capable of determining the path of the cutting device 20 relative to the part of the body to be treated based on the information generated by the camera 30.

The camera 30 is configured to accommodate part of the cutting device 20 being obscured in the image produced of objects within the optical sensing zone 31. That is, the camera 30 is configured to identify two or more features of the cutting device 20 such that the camera is able to determine the location of the cutting device 20 from the available map of the objects within the optical sensing zone 31 even when one or more of the features of the cutting device 20 are occluded by another object, for example a user's hand, in the image produced of objects within the optical sensing zone 31.

Although in the above embodiment the image of the part of the body of which an image is produced corresponds to the image of the part of the body to be treated, it will be understood that the invention is not limited thereto. For example, the camera 30 may generate image data including data representative of a lower part of a user's head, and the system 10 may extrapolate this date to generate information indicative of the upper part of a user's head.

Although the camera 30 is capable of determining the position of the cutting device 20 from the available map of the objects within the optical sensing zone 31 when at least one of the features of the cutting device 20 is identifiable in the image produced of objects within the optical sensing zone 31, it has been found that the cutting device 20 may be completely occluded in the image, for example when the cutting device 20 is disposed to treat the back of the user's head and the user's gaze direction is towards the camera 30.

When the camera 30 is unable to provide information indicative of the position of the cutting device 20, or indicates that the treating device 20 is not found within the image data representing a scene received by the camera's sensor within the optical sensing zone 21, the controller 40 is configured to refer to information indicative of the position of the cutting device 20 provided by the IMU 150. The IMU 150 is disposed in the cutting device 20 and may be operable throughout use of the system 10, or only when operated by the controller 40, for example when the camera 30 is unable to detect the cutting device 20, that is out of the optical sensing zone 31 of the camera 30.

The IMU 150 is configured to generate information indicative of the position of the cutting device 20 based on the IMU's own position in the cutting device 20. The IMU 150 provides readings of 6 axes of relative motion translation and rotation. The IMU 150 is configured to generate information indicative of the path of the cutting device 20 relative to the part of the body to be treated. Furthermore, the IMU 150 is also, or alternatively, configured to generate information indicative of the angle of orientation of the cutting device 20 relative to the part of the body to be treated.

The controller 40 may be configured to calibrate the IMU 150 based on information generated by the camera 30 when the cutting device 20 is within the optical sensing zone 31. This helps to remove positioning errors due to the readings of the IMU 150 over time.

Although in the present embodiment the controller 40 is configured to refer to information generated by the IMU 150 when the treating device is out of an optical sensing zone of the imaging module, it will be understood that the controller 40 may be configured to refer to information generated by the imaging module and the inertial navigation system module throughout use of the system 10. In an alternative embodiment, the IMU 150 may be omitted. In such an embodiment information indicative of the position, path and/or angle of orientation of the cutting device relative to the part of the body to be treated may be determined by extrapolation of the image data representing a scene received by the camera's sensor within the optical sensing zone 21. Alternatively, the controller 40 may be configured to provide feedback to a user, for example by audio signals, to guide the user to change their gaze direction relative to the camera 30 so that the cutting device 20 is within the optical sensing zone 31, and the camera is able to generate image data representing a scene received by the camera's sensor within the optical sensing zone 21.

With information indicative of the position of the part of the body to be treated, in this case the user's head, and the cutting device 20 known, it is possible to determine the position, path and/or angle of orientation of the cutting device 20 relative to the part of the body to be treated based on the image of a part of the body and the cutting device 20. The relative positions may be calculated based on vector subtraction. Therefore, the relative positions may be easily determined.

Although in the above described embodiment the relative positions of the cutting device 20 and the part of the user's head to be treated, and therefore, the path and/or orientation of the cutting device 20, are determined by the camera 30, it will be understood that the information generated by the camera 30 indicative of the position of the cutting device 20 and the part of the user's head to be treated may be provided to the controller 40 or another component of the system 10, which is configured to determine the relative positions of the cutting device 20 and the part of the user's head based on the information provided.

When the user places the cutting device 20 against the user's head and moves the device over the user's head, the system 10 is able to determine the relative positions of the cutting device 20 relative to the part of the body to be treated based on the image data generated by camera 30 of the part of the body and the cutting device. The system 10 is also able to determine the path of the cutting device 20 relative to the part of the body to be treated based on the image data generated by the camera 30 of the part of the body and the cutting device. The system 10 is also, or alternatively, able to determine the angle of orientation of the cutting device 20 relative to the part of the body to be treated based on the image data generated by camera 30 of the part of the body and the cutting device 20. The controller 40 receives data from the camera 30 and the controller 40 is configured to operate a feedback module, such as the speaker 120 or the display 130, in response to the data received to provide feedback to the user. The controller 40 is also be configured to adjust an operating characteristic in response to the data received. In this embodiment, the operating characteristic is the distance between the cutting unit 24 and the guide face 26. However, it will be understood that in an alternative embodiment the functionality to adjust an operating characteristic may be omitted.

Although in the present embodiment the operating characteristic that is changed by the controller 40 is the distance between the cutting unit 24 and the guide face 26, it will be understood that other operating characteristics of the cutting device 20 may be changed. It will be appreciated that the characteristic of the device which is changed depends on the purpose and function of the device and the invention as defined in the claims and is not limited to any particular type of device for treating hair and/or skin. Therefore, the controller may be configured to alter any characteristic of the device in dependence on the information generated by the imaging module.

The controller 40 is configured to refer to a reference profile of the part of the body to be treated. The reference profile may be stored in a look-up table. The reference profile may be stored by the memory 100. In such an arrangement, the controller 40 is configured to refer to the memory 100 to access the reference profile. In one embodiment, the reference profile is stored by the RAM 110.

The reference profile provides information of the part of the body to be treated. The reference profile also provides information of a desired setting for the operating characteristic to be altered by the controller, in this case the distance between the cutting unit 24 and the guide face 26, for each position of the cutting device 20 relative to the part of the body to be treated. However, in one embodiment information of a desired setting for the operating characteristic to be altered by the controller is omitted. The information stored by the reference profile is communicated and stored with reference to a coordinate system. One such configuration uses a polar coordinate system in which each position on the part of the body to be treated is determined by a distance from a fixed point and an angle from a fixed direction. Another configuration uses a Cartesian coordinate system. For each point a condition, such as a value, of the operating characteristic is given. Alternatively, the reference profile may define a map of the part of the user's body to be treated. In one embodiment the map is divided into predefined area and a condition of the operating characteristic is given for each area.

Although in one arrangement every possible position may be assigned a condition of the operating characteristic, in an alternative embodiment a limited number of positions are assigned a condition, and the controller 40 is configured to extrapolate and interpolate the condition for other positions based on the one or more given limited number of positions. In such an arrangement, a change in the condition for a determined position may be a step change. Alternatively, the controller 40 may configure the change to be continuous and gradual. An advantage of such an approach is that an even haircut may be achieved.

The controller 40 is configured to adjust the setting for the distance between the cutting unit 24 and the guide face 26 by comparing the provided information indicative of the position of the treating device relative to the part of the body to be treated with reference information provided by the reference profile and adjusting the distance between the cutting unit 24 and the guide face 26 to correspond to the reference data.

The controller 40 operates the actuator 28 to adjust the distance between the cutting unit 24 and the guide face 26. As the cutting unit 24 is moved over the part of the body to be treated, the controller is configured to change the operating characteristic, in this embodiment the distance between the cutting unit 24 and the guide face 26 in dependence on the determined position of the cutting device 20 relative to the part of the body to be treated. It will be understood that the cutting unit 24 and guide face 26 will both have an operating zone over which treatment will be provided. That is the cutting unit 24 will have a treating zone which, when positioned over a section of the part of the body to be treated, will affect treatment, for example hair cutting, on said section. Therefore, the treating zone may overlay two or more positions having different desired conditions of the operating characteristic. To help prevent undesired treatment, such as hair from being cut too short, in such a situation the controller 40 is configured to select the condition closest to a default condition. For example, in the present embodiment the controller 40 is configured to select the greatest distance between the cutting unit 24 and the guide face 26 provided by the two or more desired conditions. The other condition or conditions will subsequently be met by repeated, but slightly different, passes of the cutting device 20 over the part of the body to be treated.

The controller 40 is configured to track the path of the cutting device 20 relative to the part of the body to be treated. The controller 40 is configured to record the track of the path of the cutting device 20. That is, the controller 40 is configured to determine the path of the cutting device 20 and cause information indicative of the path of the cutting device 20 to be stored by the RAM 110. Alternatively, the controller 40 is configured to cause the information to be stored by the memory 100.

The controller 40 is configured to compare the information indicative of the path of the cutting device 20 with the reference profile providing information indicative of the part of the body to be treated. Therefore, the controller 40 is able to determine an area of the part of the body to be treated that has been treated. That is, the controller 40 is able to determine the area of the part of the body to be treated that has been treated based on the determined path of the cutting device 20 together with the width and/or footprint of the cutting unit 24. With such an arrangement the controller 40 is able to determine the area that the cutting unit 24 of the cutting device 20 has passed over. In the present embodiment, the controller 40 is configured to record that an area of the part of the body to be treated has been treated when it is determined that the cutting unit 24 has passed over it along any path relative to the part of the body. In an alternative embodiment the controller 40 is configured to record that an area of the part of the body to be treated has been treated when the controller 40 determines that the cutting unit 24 has passed over it along one or more predefined paths.

In an embodiment in which the controller 40 is configured to record that an area of the part of the body to be treated has been treated when the controller 40 determines that the cutting unit 24 has passed over it along one or more predefined paths relative to the part of the body to be treated, the predefined path or path is determined by the controller 40 referring to the reference profile.

In one such embodiment, the controller 40 is configured to determine a preferred path to follow based on information indicative of the direction of growth of hair on the part of the body to be treated. It will be understood that the direction of growth of hair on the part of the body to be treated may vary across different areas of the part of the body to be treated. The reference profile provides information of a direction of growth of hair across the part of the body to be treated for each position of the cutting device 20 relative to the part of the body to be treated. The information stored by the reference profile may be predicted or recorded. Although in the present embodiment the reference profile provides information of a direction of growth of hair, in another embodiment the reference profile provides a desired path only for each position of the cutting device 20 relative to the part of the body to be treated. The information stored by the reference profile is communicated and stored with reference to a coordinate system. One such configuration uses a polar coordinate system in which each position on the part of the body to be treated is determined by a distance from a fixed point and an angle from a fixed direction. Another configuration uses a Cartesian coordinate system. For each point information indicative of the direction of growth of hair is given. Alternatively, the reference profile may define a map of the part of the user's body to be treated. In one embodiment the map is divided into predefined area and information indicative of the direction of growth of hair is given for each area.

During operation of the system 10, the controller 40 is configured to refer to the reference profile providing information indicative of the direction of growth of hair. The controller 40 is then configured to operate one or more feedback modules, for example the speaker 120, display 130, and/or vibration motor 160, to provide feedback to the user to indicate the desired path of the cutting device 20 in dependence on the determined path of the cutting device 20 based on the reference profile.

An advantage of this arrangement is that it has been found that the efficiency of the cutting unit 20 is increased when the cutting unit 20 is moved along a path in an opposite direction to the direction of growth of the hair. This means that by providing feedback to indicate to a user that they should move along a path to draw the cutting unit 20 in an direction against the direction of growth of hair, the efficiency of the system 10 is somewhat maximised.

In one embodiment, the direction of growth of hair is determined by detection of the direction of growth of hair on the part of the body to be treated for a given position of the cutting device 20. In such an embodiment the system 10 further comprises a sensor 170 configured to detect the direction of growth of hair. In one embodiment, the sensor 170 is a sensor configured to detect a load acting on the driver 29 for driving the cutting unit 24. It has been found that the load acting on the cutting unit 24, and therefore the driver 29, increases when the cutting unit is moved along a path against the direction of growth of hair on a part of a body to be treated. The sensor 170 is configured to generate information indicative of the direction of growth of hair on the part of the body to be treated in dependence on the path of the cutting device 20. The controller 40 is configured to operate the feedback module, for example the display 130, to provide feedback to a user on the desired path to take based on the information generated by the sensor 170.

Alternatively, and/or in combination therewith, the controller 40 is configured to determine the area of the part of the body to be treated that has been treated in dependence on the tracked path of the cutting device 20 together with the determined direction of growth of hair along the path. That is, the controller 40 is configured to track that an area of the part of the body to be treated has been treated when the cutting device 20 has passed over said area in a direction against the direction of growth of the hair. The direction of growth of the hair may be determined by the sensor 170 or by reference to the reference profile.

In one embodiment the direction of growth of hair determined by the sensor 170 for one or more given positions of the cutting unit 24 relative to the part of the body to be treated based on information generated by the camera 30 is used to form the reference profile. That is, the controller 40 is configured to track the direction of growth based on the information generated by the sensor 170 in dependence on the position of the cutting device 20 relative to the part of the body to be treated, and to record the data to form a reference profile. The reference profile may be in the form of a look-up table or other recording configuration. The reference profile is then caused to be stored in the memory 100 or RAM 110 by the controller 40 for future reference by the controller 40.

In another embodiment, the controller 40 is configured to modify the reference profile based on the information generated by the sensor 170. In such an embodiment, the controller 40 is configured to determine the direction of growth of hair based on the information generated by the sensor 170 for one or more positions of the cutting unit relative to the part of the body based on information generated by the camera 30, and to modify the reference profile with this data to form a new reference profile. The new reference profile is then caused to be stored in the memory 100 or RAM 110 by the controller 40 for future reference by the controller 40.

When the controller 40 determines that the predefined part of the body to be treated with reference to the reference profile has been treated, either by the cutting unit 20 passing over the entire area in any direction, or in predefined directions, the controller is configured to operate one or more of the feedback modules, for example the speaker 120, display 130, and/or vibration motor 160, to provide feedback to the user that a predefined area of the part of the body to be treated, or the part of the body to be treated, has been treated. Therefore, it is possible for the system 10 to indicate to a user that the whole of the part of the body to be treated has been treated, and so no areas have been missed.

In the present embodiment, the controller 40 is configured to operate the speaker 120 to emit a sound when the controller determines that the part of the body to be treated as defined by the reference profile referred to by the controller has been treated. Alternatively, the controller 40 may be configured to operate one or more other feedback modules, such as the display 130, another visual indicator, or the vibration motor 160 to provide tactile feedback.

In one embodiment, the controller 40 is configured to operate one or more feedback modules, for example the speaker 120, display 130, and/or vibration motor 160, to provide active feedback to a user during operation of the system 10. In one such embodiment, the controller 40 is configured to operate the display 130 to show a map of the part of the body to be treated based on the reference profile referred to by the controller 40. The controller 40 may then be configured to operate the display 130 to show the path of the cutting device 30 over the part of the body to be treated, and to show the part of the body that has been treated. The system 10 is then able to easily provide feedback to the user of the part of the body to be treated that has been treated and that has yet to be treated. The display may show an actual or schematic map of the part of the body to be treated.

In one embodiment, the system 10 is configured to provide feedback during use to indicate a path that the user should follow based on the reference profile referred to by the controller 40. With such a system 10, the controller 40 may be configured to operate one or more of the feedback modules to provide one or more of visual, audible or tactile feedback. The controller 40 may be configured to operate the speaker 120, the display 130 or the vibration motor 160, for example. It will be understood that different arrangements may be used within the system 10 to provide feedback to a user of the desired path to take.

In one embodiment, the cutting device 20 has two vibration motors (not shown) acting as tactile feedback means. The vibration motors are spaced apart, for example on either side of the cutting device 20. The controller 40 is then configured to operate each of the vibration motors independently to indicate the desired direction in which to move the cutting device 20. For example, if the controller 40 determines that the cutting device 20 should be moved to the left relative to the part of the body to be treated, the controller 40 is operable to operate the vibration motor on the left hand side of the cutting device 20.

In another arrangement, the cutting device 20 has a shifting balance module (not shown). In such an embodiment the controller 40 is operable to operate the shifting balance module to adjust the centre of gravity of the cutting device 20. This will indicate to the user the desired direction to move the cutting device 20 relative to the part of the body to be treated.

In yet another embodiment, the cutting device 20 has two wheels (not shown) on the cutting head 22. In such an embodiment the controller 40 is operable to allow rotation, or prevent rotation, of one or both of the wheels. This will indicate to the user the desired direction to move the cutting device 20 relative to the part of the body to be treated.

It will be understood that one or more different feedback means may be used to provide an indication to the user of the desired path of the cutting device relative to the part of the body to be treated.

Once a full transversal of the part of the body to be treated has been completed and the controller 40 has operated one or more of the feedback modules to indicate that the treatment of the part of the body to be treated has been completed, the user is able to move the cutting device 20 away from the part of the body to be treated. It will be understood that the cutting device 20 may be moved away from the part of the body to be treated during treatment, and the system 10 will be able to continue to operate when the cutting device 20 is moved back towards the part of the body to be treated.

Although in the above described embodiment one reference profile is used, it will be understood that the controller 40 may be configured to select from two or more reference profiles in response to a user input, or in response to information generated by the camera based on an image of a part of the body. For example, the controller 40 may be configured to select a reference profile based on a size of the head of the user as determined by the camera 30. Furthermore, although in the above described embodiment one reference profile is referred to by the controller 40 to obtain the operating characteristic and the direction of growth of hair, for example, it will be understood that separate reference profiles may be used.

In an alternative embodiment not shown in the Figures, the controller does not adjust the performance of an actuator in dependence on the information generated by the imaging module, but rather informs the user of the cutting device via one or more feedback modules, for example the speaker 120 and/or display 130. For example, while the cutting device is in use the controller will alter an operating characteristic of the feedback unit to inform the user in dependence on the information generated by the imaging module so that they can take the appropriate action. The feedback module may provide an acoustic signal, in the form of an audible sound such as a beeping sound. Alternatively, the feedback module may provide tactile feedback in the form of vibrations that are felt by the user via the handle of the device. Alternatively, the feedback module may provide an optical signal, such as flashing light or other optical indicator. It will be appreciated that the feedback module may also provide more than one of the above mentioned signals in dependence on the information generated by the imaging module.

Although in the above described embodiments the camera is a depth camera, it will be understood that alternative imaging modules may be used. For example, alternative vision systems acting as an imaging module may be used. Such an alternative vision system may include a non-range camera, for example using an object reconstruction technique, or stereo vision, temporal analysis of video to reconstruct range data and detect the head position and cutting device position, analysis of thermal camera images, analysis of data from ultrasonic sensors, and/or analysis of data from capacitive sensors.

Although in the above described embodiments, the system and method are described as a system for cutting hair on a part of a body and a method of cutting hair on a part of a body, it will be understood that the invention is not limited thereto. For example, the system and method may be used as an alternative treatment of a part of the body to be treated.

It will be appreciated that the system and/or method as defined in the claims may be used for any method of treating hair or skin. For example, the treating device may be an epilator, shaver, trimmer, exfoliator, microdermabrasion device, laser hair cutting device, moisturiser, intense pulsed light based device, or any other powered device which interacts with the hair and/or skin of a user. The treating device may apply a substance such as colouring agent, shampoo, medical substance or any other substance to the hair or skin of the user. Possible alternative uses include systems incorporating one or more non-invasive or invasive treatments such as a tooth brush, a shaver, alternative types of hair removal other than cutting, skin cleaning, skin tanning, and/or skin rejuvenation. In such embodiments, the treating of a part of body may include application of light, application of a lotion or other fluids, and/or puncturing.

The device may have two or more treating units. In such an arrangement the controller 40 may be configured to adjust an operating characteristic of the different treating units in different ways. For example, in an arrangement with two cutting units the cutting height of one of the cutting units may be altered independently of the other of the cutting units. Therefore, it will be appreciated there are many ways in which the controller is able to adjust an operating characteristic of a device having multiple treating units.

It will be appreciated that the term "comprising" does not exclude other units or steps and that the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A system for treating a part of a body, the system comprising:

a treating device;

a position identifier configured to generate position information of a position of the treating device relative to the part of the body to be treated;

a load sensor configured to determine a load acting on the treating device;

a renderer; and a controller configured to:

operate the renderer to provide feedback to a user of a path taken by the treating device based on the position information generated by the position identifier, determine treatment information based on the load, the treatment information including when the part of the body is being treated, and output the treatment information to the renderer to render a path to be taken.

2. The system according to claim 1, wherein the controller is configured to determine a current path taken by the treating device and track the current path of the treating device relative to the part of the body to be treated and to compare the current path tracked by the controller with a reference profile indicative of the part of the body to be treated to determine an area of the part of the body to be treated that has been treated by the treating device based on the current path tracked by the controller.

3. The system according to claim 1, wherein the renderer includes a display and the controller is configured to operate the renderer to display on the display the path to be taken by the treating device over the part of the body to be treated, and to show a part of the body that has been treated.

4. The system according to claim 1, wherein the renderer includes a display and the controller is configured to operate the renderer to notify the user of completion of treatment of a predefined area of the part of the body to be treated, when the controller has determined that the predefined area has been treated by the treating device, and to operate the renderer to notify the user of completion of treatment of an entire area of the part of the body to be treated when the controller has determined that the treating device has treated the entire area of the part of the body to be treated.

5. The system according to claim 1, wherein the system for treating the part of a body to be treated is a system for cutting hair on the part of a body to be treated, and the treating device is a cutting device.

6. The system according to claim 5, wherein the controller is configured to refer to a reference profile indicative of hair on the part of the body to be treated for a given position or positions of the cutting device relative to the part of the body to be treated, and the controller is further configured to operate the renderer to provide an indication of a desired angle of orientation to be used of the cutting device relative to the part of the body to be treated based on the reference profile and the position information generated by the position identifier.

7. The system of claim 6, wherein the controller is configured to operate the renderer to indicate at least one of the path being taken and the desired angle of orientation based on the reference profile and at least one of the path being taken and the desired angle of orientation.

8. The system according to claim 1, wherein the controller is configured to operate the renderer to provide an indication of a desired angle of orientation and to display the path to be taken based on the path taken and the indication of the desired angle of orientation.

9. The system according to claim 1, wherein the renderer is configured to provide at least one of audible and tactile feedback to the user.

10. The system according to claim 9, wherein the controller is configured to operate the renderer to display the path to be taken on a display based on the path taken, and wherein the controller is configured to operate the display to show a map of the part of the body to be treated on the display, and to provide on the map the path taken, the path to be taken, and an indication of a desired angle of orientation.

11. The system according to claim 1, wherein the position identifier comprises an inertial measurement device and an imager configured to generate the position information of the position of the treating device relative to the part of the body to be treated based on an image of the part of the body and the treating device, wherein the controller is configured to operate the inertial measurement device only when the imager is unable to detect the treating device.

12. The system according to claim 11, wherein the controller is configured to calibrate the inertial measurement device based on position information generated by the imager.

13. The system according to claim 1, wherein the position identifier comprises an electromagnetic field detector configured detect changes in an electromagnetic field to generate the position information of the position of the treating device relative to the part of the body to be treated based on a detected electromagnetic field.

14. A method of treating a part of a body to be treated using a treating device, the method comprising steps of:

generating position information indicative of a position of the treating device relative to the part of the body to be treated using a position identifier;

determining by a load sensor a load acting on the treating device;

determining by a controller a path to be taken by the treating device relative to the part of the body to be treated in dependence of the position information generated by the position identifier;

operating by the controller a renderer to provide feedback to a user of a path taken by the treating device based on the position information generated by the position identifier;

determining by the controller treatment information based on the load, the treatment information including when the part of the body is being treated;

providing by the controller the treatment information to the renderer; and outputting by the renderer the treatment information to render a path to be taken.

15. The method of claim 14, further comprising steps of:

determining a current path taken by the treating device;

tracking at least one of the current path and the angle of orientation of the treating device relative to the part of the body to be treated by the controller; and comparing the at least one of the current path and the angle of orientation of the treating device relative to the part of the body to be treated tracked by the controller with a reference profile indicative of the part of the body to be treated to determine an area of the part of the body to be treated that has been treated by the treating device based on the at least one of the current path and the angle of orientation tracked by the controller.

16. The method of claim 15, wherein the step of operating the renderer provides an indication of the area of the part of the body that has been treated by the treating device.

17. The method of claim 14, the treating device is a cutting device, wherein the step of operating the renderer provides an indication of a desired angle of orientation and displays at least one of the path to be taken based on the path taken and the indication of the desired angle of orientation to be used of the cutting device relative to the part of the body to be treated based on a reference profile indicative of hair and the position information generated by the position identifier.

18. The method according to claim 14, wherein the position identifier comprises an inertial measurement device and an imager configured to generate the position information of the position of the cutter relative to the part of the body to be treated based on an image of the part of the body to be treated and the treating device, wherein the controller is configured to operate the inertial measurement device only when the imager is unable to detect the treating device.

19. A system for cutting hair of a skin comprising:

a cutter;

a position identifier configured to generate position information of a position of the cutter relative to the skin;

a load sensor configured to determine a load acting on the cutter;

a renderer; and a controller configured to:

operate the renderer to provide feedback to a user of a path taken by the cutter based on the position information generated by the position identifier determine treatment information based on the load, the treatment information including when the hair is being cut, and output the treatment information to the renderer to render a path to be taken.

20. The system according to claim 19, wherein the position identifier comprises an inertial measurement device and an imager configured to generate the position information of the position of the cutter relative to the skin based on an image of the skin and the cutter, wherein the controller is configured to operate the inertial measurement device only when the imager is unable to detect the cutter.

* * * * *